US005457769A

United States Patent [19]

Valley

[11] Patent Number: 5,457,769

[45] Date of Patent: Oct. 10, 1995

[54] METHOD AND APPARATUS FOR DETECTING THE PRESENCE OF HUMAN VOICE SIGNALS IN AUDIO SIGNALS

[75] Inventor: Robert A. Valley, Branford, Conn.

[73] Assignee: Earmark, Inc., Hamden, Conn.

[21] Appl. No.: 351,882

[22] Filed: Dec. 8, 1994

Related U.S. Application Data

[63] Continuation of Ser. No. 39,874, Mar. 30, 1993, abandoned.

[51] Int. Cl.[6] ..... G10L 9/00

[52] U.S. Cl. ..... 395/2.19; 395/2.42; 395/2.84

[58] Field of Search ..... 395/2.14, 2.18, 395/2.19, 2.42, 2.57, 2.62, 2.84; 381/39, 46, 50

[56] References Cited

U.S. PATENT DOCUMENTS

| | | | |
|---|---|---|---|
| 3,369,076 | 5/1964 | Bakis | 381/50 |
| 3,989,896 | 11/1976 | Reitboeck | 395/2.18 |
| 4,075,423 | 2/1978 | Martin et al. | 395/2.18 |
| 4,187,396 | 2/1980 | Luhowy | 381/46 |
| 4,718,097 | 1/1988 | Uenoyama | 395/2.19 |

OTHER PUBLICATIONS

S. J. Mason and H. J. Zimmermann, li Electronic Circuits, Signals, and Systems, J. Wiley & Sons, New York, N.Y., 1960, pp. 519–520.

J. W. Nilsson, *Electric Circuits,* 3rd Edition, Addison–Wesley, Reading Mass., 1990, pp. 708–709.

*Primary Examiner*—Allen R. MacDonald
*Assistant Examiner*—Michael A. Sartori
*Attorney, Agent, or Firm*—McCormick, Paulding & Huber

[57] ABSTRACT

The presence of human voice signals in audio signals is detected by a method and apparatus based on the recognition that fundamental frequency components of human voice signals are separated from one another by a characteristic frequency difference ranging from about 120 hertz to about 180 hertz. A limited frequency band portion of the audio signals is mixed and filtered to produce a signal containing the difference frequencies of the frequency components included in the limited frequency band portion of the audio signals, and the latter signal is processed to determine whether it contains a component of significant magnitude representing the human voice characteristic difference frequency.

6 Claims, 2 Drawing Sheets

METHOD AND APPARATUS FOR DETECTING THE PRESENCE OF HUMAN VOICE SIGNALS IN AUDIO SIGNALS

This is a continuation of application Ser. No. 08/039,874 filed on Mar. 30, 1993, abandoned.

BACKGROUND OF THE INVENTION

The present invention relates generally to speech or voice recognition and deals more specifically with speech detection in high noise environments to activate a voice operated switch. The invention deals more particularly with a method and related apparatus which distinguishes speech or voice from other sounds over a wide range of noise levels to activate a voice operated switch in response to only speech or voice signals.

A voice operated switch, commonly referred to in the trade as VOX is often used to activate some device or apparatus, such as, for example, a telephone speakerphone amplifier and transmitter, radio transmitter, audio amplifier or the like wherein the VOX is designed to respond to a user's voice or some other sound to activate the device to allow "handsfree" operation thus freeing the user's hands for other tasks. Such voice operated switches or VOX's are particularly useful with radio communication devices, such as, headphone radio transmitters of the type generally used at industrial, manufacturing and construction sites. Typically, such a VOX communication device includes a microphone, radio transmitter/receiver and headphones to provide two-way audio communication between users who may be separated from one another by some distance, for example, between a crane operator located substantially above the ground and ground personnel directing the operations of the crane operator who may be out of visual contact with respect to the activity site. Such VOX communication devices are also necessary in high ambient noise work environments to allow workers or supervisory personnel to communicate with one another in the presence of machine or other noise which would render normal voice communication, even at shouting levels, impossible. The utility of VOX communication devices is well known and understood by those in the art.

One problem generally associated with known VOX's is the inability or difficulty to readily discriminate between speech or voice and other sounds or environmental noise and a response delay is deliberately built in to insure that the input energy detected is likely to be voice or speech before the VOX is activated. This is the reason that the first portion of speech is often missing in communications utilizing VOX communication devices.

Another problem generally associated with known VOX's is the necessity to continually manually reset the threshold setting of the VOX to a single environmental noise level for a specific noise environment. This is a particular disadvantage if a user moves about between a number of different noise environments, particularly when moving from a high noise environment to a low noise environment. The user must speak or shout loudly enough in the low noise environment to exceed the preset threshold level set for the high noise environment to activate the VOX.

A yet further problem generally associated with known VOX's is that they become activated upon the energy level of any audible sound exceeding the threshold setting for the VOX thus causing the VOX communication device to become activated unexpectedly.

It would be useful therefore to provide a VOX that automatically adjusts the threshold setting to permit operation over a wide range of noise levels without the necessity of manually resetting the threshold levels to accommodate changing noise levels.

It would also be useful to provide a VOX that discriminates between noise energy and voice energy so that the VOX only responds to speech or voice to prevent accidental activation in high noise environments.

It is a general aim of the present invention therefore to provide a VOX that has a self-adjusting threshold level for activation in different level noise environments and one which discriminates between speech or voice and other sounds including noise energy to prevent accidental activation of the VOX.

It is a further aim of the present invention to provide a VOX which is easy to use, operates reliably in high noise environments, typically, 115 dB or higher.

It is a yet further aim of the present invention to provide a VOX which detects and discriminates between speech or voice and other sounds without the use of complicated and relatively expensive digital signal processing (DSP) techniques and circuitry.

SUMMARY OF THE INVENTION

In accordance with one aspect of the present invention, apparatus for detecting speech or voice discriminates from other sounds such as noise to activate a voice operated switch (VOX) by detecting the spectral frequency characteristic of a speech formant. Means such as a microphone converts sounds which may include human voice signals to an electrical analog voltage signal which is passed through a bandpass filter to limit spectral frequencies. In a preferred embodiment, the bandwidth is set between 700 and 1100 hertz. The filtered signal is multiplied by a detector to provide sum and difference frequencies of fundamental speech characteristics which are in turn passed through a second bandpass filter having a frequency bandwidth designed to pass the difference frequencies and reject the sum frequencies. In a preferred embodiment, the bandwidth is set between 120 and 180 hertz. Means coupled to the output of the second bandpass filter detects signals from the filter. A comparator generates an output voltage signal to activate the voice operated switch in response to the detected signal exceeding a predetermined voltage reference potential.

A further aspect of the invention relates to a method for detecting speech or voice which may be included with other sounds such as noise by bandpass filtering an electrical analog signal representative of the sound to limit the spectral frequencies to a desired bandwidth; producing sum and difference frequencies of fundamental characteristic speech frequencies within the desired bandwidth; bandpass filtering the sum and difference frequencies to pass only those signals having a spectral frequency characteristic of a speech formant; producing an output signal in response to the presence of a signal having a spectral frequency characteristic of a speech formant.

BRIEF DESCRIPTION OF THE DRAWINGS

Other features and advantages of the present invention will become readily apparent from the following written description and from the figures wherein.

WRITTEN DESCRIPTION OF PREFERRED EMBODIMENTS

In order to better appreciate and understand the present invention, it is first necessary to understand the concept upon which the invention is based. Applicant has found that speech or voice may be identified and distinguished from other non-speech sounds including noise falling within the voice frequency bandwidth by detecting formants. A formant is defined as a characteristic component of the quality of a speech sound and specifically is characterized as any of several resonance bands held to determine the phonetic quality of a vowel. Applicant has determined by observation and experimentation that speech, in general, exhibits the requisite characteristic component frequencies at approximately 150 hertz separation from one another. Applicant has also determined that a signal having a spectral distribution exhibiting this characteristic component is more likely to be speech than any other signal such as noise and can be identified because the energy of the formant is modulated by the human voice tract. Accordingly, the determination and detection of the presence of a formant in the spectral frequency of an input sound is taken to be speech energy rather than noise energy and the detection of the first formant substantially, immediately activates the VOX.

Figure 1:
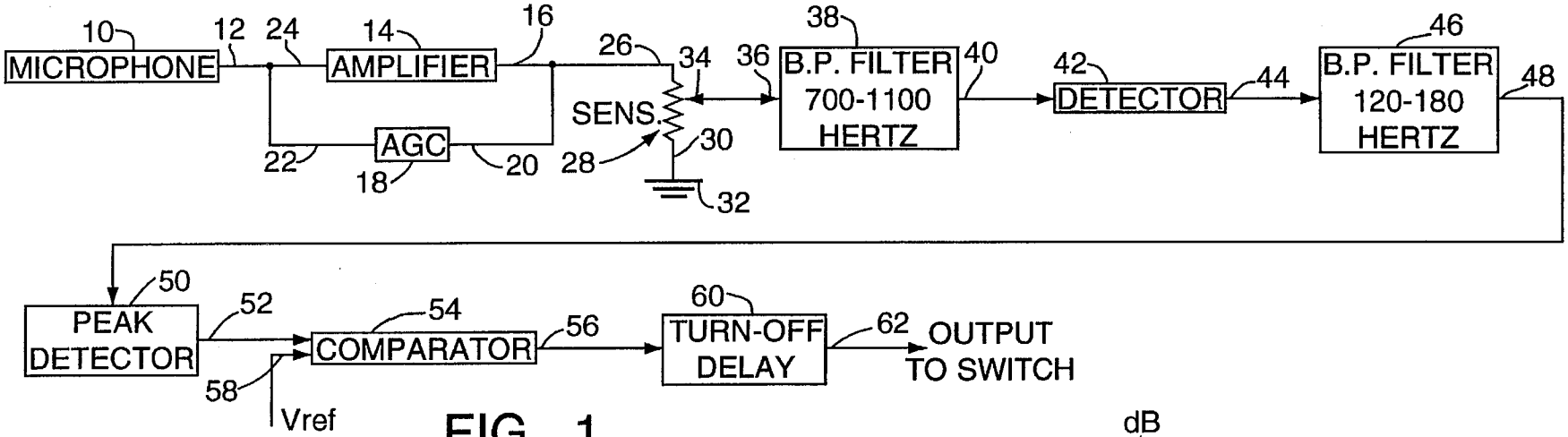
FIG. 1 is a schematic, functional block diagram illustrating t major components comprising the VOX embodying the present invention.
Figure 2:
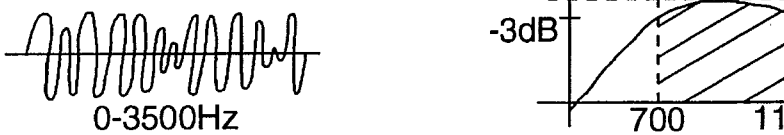
FIG. 2 is a general waveform representation of an analog voice frequency signal.

Turning now to the drawings and considering the invention in greater detail, FIG. 1 shows a schematic functional block diagram illustrating the major functional components for one possible implementation of the voice operated switch (VOX) embodying the present invention. Analog frequency signals in the form of speech, voice, external ambient noise or other sounds are input to the circuit via a microphone 10 which converts the acoustic soundwaves to an electrical signal at the output 12 of the microphone. Such a converted soundwave to electrical signal may appear as the general waveform representation of an analog voice frequency signal as illustrated in FIG. 2. Still considering FIG. 1, the analog signal at the output 12 of the microphone 10 is input to an amplifier 14 and is amplified to produce a signal at the output 16 of the amplifier 14 to a magnitude greater than the magnitude permitted by the automatic gain control circuit 18. The automatic gain control circuit 18 has its input 20 coupled to the output 16 of the amplifier 14 and its output 22 coupled to the input 24 of the amplifier 14. The attack time of the automatic gain control circuit 18 is preferably and deliberately delayed for approximately 5 milliseconds to allow the very first part of any word or sound to reach a magnitude at the output 16 of the amplifier 14 which is limited only by the supply voltage to the amplifier. The delay in the attack time is not readily discernable as distortion to a listener and provides a sharp spike of energy to the detection system of the automatic gain control thereby insuring rapid activation of the voice operated switch as described below.

The output 16 of the amplifier 14 is coupled to one end 26 of a potentiometer 28 having its opposite end 30 coupled to a ground reference voltage potential 32. The potentiometer 28 has a wiper 34 which is movable to change the ratio of the resistance of the potentiometer between its terminals 26, 34 and 30 to adjust the magnitude of the voltage signal applied to the input 36 of a frequency conditioning and limiting bandpass filter 38. The adjustment of the potentiometer 28 affects the sensitivity setting of the voice operated switch, that is, as the wiper 34 is adjusted to be closer to the end 30 of the potentiometer 28, an input analog frequency signal at the microphone 10 will require a higher volume to activate the voice operated switch. In contrast, as the wiper 34 is moved closer to the end 26 of the potentiometer 28, the sensitivity of the voice actuated switch is increased so that a lower volume voice frequency signal at the microphone 10 activates the voice operated switch.

Figure 3:
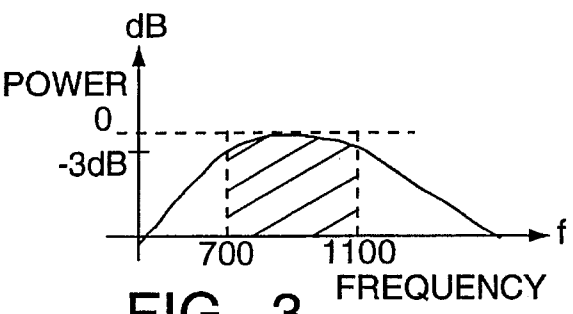
FIG. 3 is an illustrative response characteristic for a bandpass filter for conditioning and limiting voice frequency energy and noise energy to a desired bandwidth.

The bandpass filter 38 is set in the illustrated embodiment to have a 400 hertz bandwidth and a corresponding illustrative response characteristic for the bandpass filter is shown in FIG. 3. The bandpass filter 38 functions to condition and limit voice, sound and noise frequencies to a desired bandwidth to pass frequencies forming the formant and comprising the highest energy output of human speech. The bandpass filter 38 substantially eliminates all sounds corresponding to frequencies outside the passband from activating the voice operated switch. The bandwidth is chosen or selected to accommodate the greatest number of users and in the present illustrative embodiment, a 400 hertz bandwidth between 700 and 1100 hertz has been found to accommodate most people's speech, particularly males. The bandwidth and sensitivity may require "fine tuning" or adjustment for some males and particularly for recognition of female speech. The voltage signal at the output 40 of the bandpass filter 38 includes the first formant energy and which formant has the low frequency modulation component. The voltage signal at the output 40 is coupled to a detector 42 for further processing.

Figure 6:
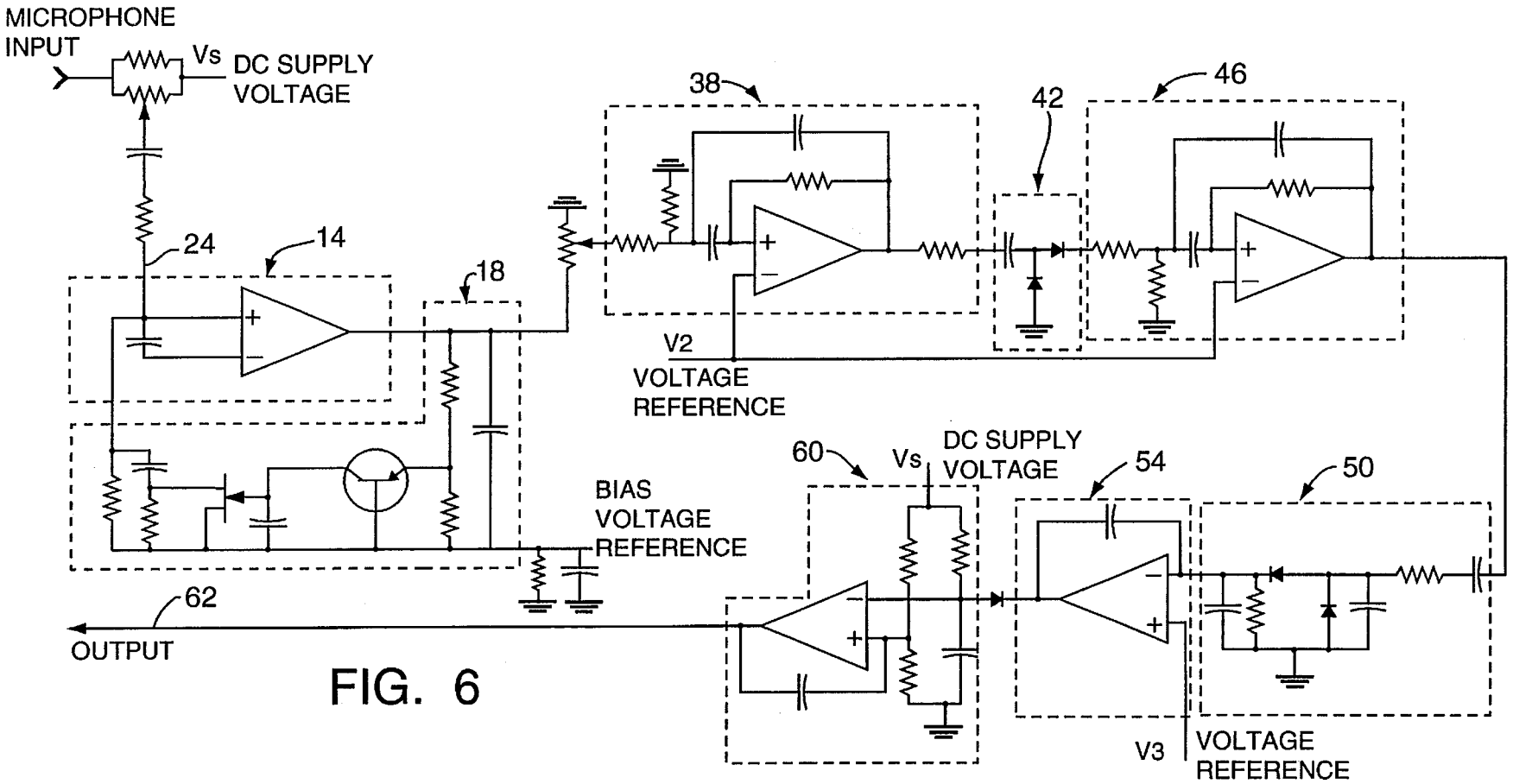
FIG. 6 is an electrical schematic diagram of major electrical circuit components illustrating one possible circuit configuration for implementing a VOX embodying the present invention.

The detector 42 functions as a mixer upon whose output 44 a mixed voltage signal comprising the fundamental frequency signal and the sum and difference frequencies of the fundamental frequencies is carried. The detector 42, as illustrated in the corresponding circuit schematic of a preferred embodiment shown in FIG. 6, is a halfwave diode detector and generates the sum and difference frequencies in accordance with the characteristics of a square-law diode whose operation is well understood by those skilled in the art. Reference may be made to numerous text books and trade literature for a further explanation of the operation of a square-law diode operating as a mixer.

Figure 4:
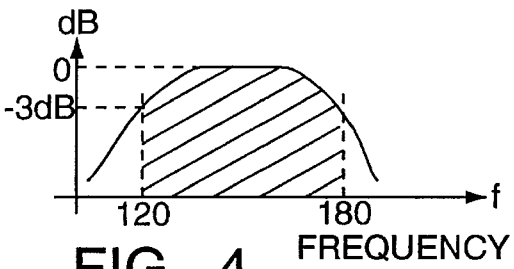
FIG. 4 is an illustrative response characteristic for a bandpass filter for passing formant frequency energy.
Figure 5:
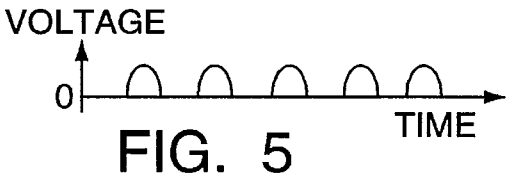
FIG. 5 is a general waveform representation of the detected formant frequency energy.

The output signal from the detector 42 is passed through a second bandpass filter 46 which has an approximate 60 hertz bandwidth extending from 120 hertz to 180 hertz to pass the formant characteristic frequency component. An illustrative response characteristic for bandpass filter 46 is shown in FIG. 4. The voltage signal at the output 48 of the bandpass filter 46 contains only the difference frequency products of the processed speech from the detector 42. The output voltage signal of the bandpass filter 46 is shown for illustrative purposes in FIG. 5 as a series of peaks corresponding to the difference frequencies of the formant fundamental frequencies. The peak detector 50 has its input coupled to the output 48 of the bandpass filter 46 and responds to the peak signals present at its input to generate a voltage signal at its output 52.

The voltage at the output 52 of the peak detector 50 is fed to a comparator 54 which in turn provides a voltage pulse signal at its output 56 when the magnitude of the voltage at the output 52 of the peak detector 50 exceeds a preset voltage reference potential coupled to the input 58 of the comparator 54. The comparator voltage signal at the output 56 is coupled to the output 62 of a turn-off delay circuit 60 and which output signal from the turn-off delay circuit is used to activate the voice operated switch.

The turn-off delay circuit 60 is a delay circuit in the sense that the voltage signal at the output 62 is maintained to keep the voice operated switch in its activated state for a given time duration so that the voice operated switch remains activated to insure that trailing speech, particularly at the end of a sentence, is captured and transmitted by a device actuated by the voice operated switch. The turn-off delay time interval is restarted each time that the output voltage signal at the peak detector 50 exceeds the voltage reference potential at the input 58 to the comparator 54 causing the comparator output voltage signal to change state to reset the timing sequence. Accordingly, the voltage signal at the output 62 of the turn-off delay circuit 60 is continually fed to the voice operated switch to maintain the voice operated switch in its operative state for the duration that voice or speech produced frequencies are input to the microphone 10 and detected by the circuitry as disclosed above.

Turning now to FIG. 6, an electrical schematic diagram for practicing the method and apparatus of the present invention is shown therein and corresponds to the functional block diagram illustrated in FIG. 1 wherein the dashline boxes reference numerals correspond to the functional blocks of FIG. 1. Each of the dashline boxes in FIG. 6 show a basic circuit component configuration to achieve the circuit operation and function as described above. The details of the circuit implementation based on the electrical schematic diagram shown in FIG. 6 will be readily apparent to those skilled in the art.

A method and apparatus for detecting speech or voice, particularly in high noise environments, to activate a voice operated switch has been described above in a preferred embodiment. It will be obvious to those skilled in the art that the above described embodiment may be changed and modified without departing from the spirit and scope of the invention and therefore the invention has been described by way of illustration rather than limitation.

The invention claimed:

1. Apparatus for detecting human voice signals in audio signals to activate a voice operated switch, said apparatus comprising:

means for sensing audio signals which may include human voice signals, said human voice signals comprising fundamental frequency components characteristic of human voice and which fundamental frequency components have an approximate characteristic frequency difference, said sensing means having means for converting said audio signals into an electrical analog voltage signal;

a first bandpass filter coupled to said sensing means for frequency filtering said electrical analog voltage signal to produce a first filtered voltage signal having a limited frequency band including the frequencies of at least some of said fundamental frequency components characteristic of human voice;

an electronic mixer coupled to said first bandpass filter for receiving said first filtered voltage signal for producing a mixer output voltage signal including difference frequency components representing differences of the frequency components included in said first filtered voltage signal;

a second bandpass filter coupled to said electronic mixer for filtering said mixer output voltage signal, said second bandpass filter having a pass band such as to pass said difference frequency components of said mixer output voltage signal and to reject frequency components of said mixer output voltage signal having frequencies falling within said limited frequency band of said first bandpass filter so as to produce an output voltage signal from said second bandpass filter the magnitude of which second bandpass filter output signal is dependent on the magnitude of said fundamental frequency components characteristic of human voice included in said audio signals; and means coupled to said second bandpass filter for producing a signal indicating the presence of human voice signals in said audio signals when said output voltage signal from said second bandpass filter exceeds a given magnitude characteristic.

2. Apparatus as defined in claim 1 wherein said means coupled to said second bandpass filter for producing a signal indicating the presence of human voice includes a means for producing a voltage magnitude signal related to said output voltage from said second bandpass filter, for comparing said voltage magnitude signal with a reference voltage of preset magnitude, and for producing a further output voltage signal when said voltage magnitude signal exceeds said reference voltage magnitude; and means coupled to said comparator for generating a signal to activate a voice operated switch in response to the presence of said output voltage signal from said comparator.

3. Apparatus for detecting human voice signals to control a voice operated switch, said apparatus comprising:

means for inputting an input analog voltage signal representative of an audible sound which may include human voice signals;

a first bandpass filter coupled to said inputting means for filtering said input analog voltage signal to produce a first filtered signal having frequency components within a first frequency band of limited width;

a mixer coupled to said first bandpass filter to produce a mixer output voltage signal including the difference frequencies between at least some of the frequency components of said first filtered signal;

a second bandpass filter coupled to said mixer for filtering said first filtered voltage signal to produce a second filtered voltage signal having frequency components within a second frequency band including at least some of said difference frequencies of said mixer output voltage signal and excluding the frequencies of said first frequency band; and means coupled to said second bandpass filter to generate an output voltage signal to control the condition of a voice operated switch in response to the magnitude of said second filtered voltage signal.

4. Apparatus for detecting human voice signals to control a voice operated switch as defined in claim 3 wherein said first bandpass filter has a pass band width of approximately 400 hertz starting at a frequency greater than 180 hertz, and said second bandpass filter has a pass band extending from approximately 120 hertz to approximately 180 hertz.

5. Apparatus for detecting human voice signals to control a voice operated switch as defined in claim 4 wherein said first band pass filter has a pass band extending between approximately 700 hertz and approximately 1100 hertz.

6. A method for detecting human voice signals to control a voice operated switch, said method comprising the steps of:

inputting an input analog voltage signal which may include human voice signals;

bandpass filtering said input analog voltage signal to produce a first filtered voltage signal having frequency components limited to a frequency band extending between approximately 700 hertz and approximately 1100 hertz;

mixing said first filtered signal to generate a mixed voltage signal including difference frequencies existing between the frequency components of said first filtered voltage signal;

bandpass filtering said mixed voltage signal to produce a second filtered signal limited to a frequency band extending between approximately 120 hertz and 180 hertz; and using said second filtered signal to control the condition of said voice operated switch.

* * * * *